US009644904B2

(12) United States Patent
Curtis

(10) Patent No.: US 9,644,904 B2
(45) Date of Patent: May 9, 2017

(54) DIRECT FORCED DRAFT FLUID COOLER/COOLING TOWER AND LIQUID COLLECTOR THEREFOR

(71) Applicant: SYNTECH TOWERS, L.L.C., Prairieville, LA (US)

(72) Inventor: Harold Dean Curtis, Oklahoma City, OK (US)

(73) Assignee: Syntech Towers, LLC, Prairieville, LA (US)

( * ) Notice: Subject to any disclaimer, the term of this patent is extended or adjusted under 35 U.S.C. 154(b) by 128 days.

(21) Appl. No.: 14/660,871

(22) Filed: Mar. 17, 2015

(65) Prior Publication Data

US 2015/0241148 A1 Aug. 27, 2015

Related U.S. Application Data

(62) Division of application No. 13/148,541, filed as application No. PCT/US2010/024929 on Feb. 22, 2010, now Pat. No. 9,033,318.

(60) Provisional application No. 61/217,822, filed on Jun. 5, 2009, provisional application No. 61/208,995, filed on Mar. 3, 2009, provisional application No. 61/270,723, filed on Jul. 13, 2009.

(51) Int. Cl.

| | |
|---|---|
| ***F28C 1/00*** | (2006.01) |
| ***F28F 25/04*** | (2006.01) |
| ***F28D 5/02*** | (2006.01) |
| ***F28F 25/02*** | (2006.01) |

(52) U.S. Cl.

CPC ..... *F28F 25/04* (2013.01); *F28C 1/00* (2013.01); *F28D 5/02* (2013.01); *F28F 25/02* (2013.01); *Y10T 137/8593* (2015.04)

(58) Field of Classification Search

CPC ..... F28C 1/00; F28D 5/02; F28F 25/02; F28F 25/04; Y10T 137/8593

USPC ..... 261/97, 110, DIG. 11, DIG. 85

See application file for complete search history.

(56) References Cited

U.S. PATENT DOCUMENTS

| | | | |
|---|---|---|---|
| 1,647,281 | A | 11/1927 | Doyle |
| 1,803,854 | A | 5/1931 | Kniskern |
| 1,866,193 | A | 7/1932 | Coutant |
| 3,217,631 | A | 11/1965 | Thompson et al. |
| 3,290,025 | A | 12/1966 | Engalitcheff, Jr. |
| 3,384,165 | A | 5/1968 | Mathews |
| 3,402,653 | A | 9/1968 | Lex |
| 3,647,191 | A | 3/1972 | Fordyce |
| 3,750,418 | A | 8/1973 | Maudlin |
| 3,803,997 | A | 4/1974 | Van Raden |

(Continued)

FOREIGN PATENT DOCUMENTS

| | | | |
|---|---|---|---|
| DE | 2606429 | A1 | 9/1977 |
| EP | 0931993 | A1 | 7/1999 |

(Continued)

*Primary Examiner* — Charles Bushey

(74) *Attorney, Agent, or Firm* — Jones Walker LLP

(57) ABSTRACT

A cooling tower is provided with fans at the bottom of the unit, and a plurality of Savers of water collection troughs or channels above the fans to capture water droplets sprayed downwardly from the top of the device through a heat exchanger above the collection troughs. The collection troughs supply the collected water to one or more gutters inside the housing which lead the water to an external collection tank from which the water is recirculated to the top of the tower.

15 Claims, 13 Drawing Sheets

(56) References Cited

U.S. PATENT DOCUMENTS

| | | | | |
|---|---|---|---|---|
| 3,834,129 | A | 9/1974 | Darlinger et al. | |
| 3,968,738 | A | 7/1976 | Matzke | |
| 4,014,669 | A * | 3/1977 | Thompson | B01D 45/06 261/DIG. 77 |
| 4,164,399 | A | 8/1979 | Kannapell | |
| 4,196,157 | A | 4/1980 | Schinner | |
| 4,198,215 | A | 4/1980 | Regehr | |
| 4,273,733 | A | 6/1981 | Kals | |
| 4,416,835 | A * | 11/1983 | Bosne | F28F 25/04 261/110 |
| 4,500,330 | A * | 2/1985 | Bradley, Jr. | B01D 45/08 261/112.1 |
| 4,521,350 | A | 6/1985 | Lefevre | |
| 4,759,315 | A | 7/1988 | Chiou et al. | |
| 4,981,113 | A | 1/1991 | Kannan et al. | |
| 5,000,883 | A | 3/1991 | Leva | |
| 5,227,095 | A | 7/1993 | Curtis | |
| 5,268,011 | A | 12/1993 | Wurz | |
| 5,474,832 | A | 12/1995 | Massey | |
| 5,487,531 | A | 1/1996 | Curtis | |
| 5,545,356 | A | 8/1996 | Curtis | |
| 5,958,306 | A | 9/1999 | Curtis | |
| 6,527,258 | B2 | 3/2003 | Bartlock | |
| 8,585,024 | B2 * | 11/2013 | Ferree | F28C 1/02 261/109 |
| 9,033,318 | B2 * | 5/2015 | Curtis | F28D 5/02 261/110 |
| 2006/0021393 | A1 | 2/2006 | Oda et al. | |
| 2007/0187851 | A1 | 8/2007 | Facius et al. | |
| 2011/0049733 | A1 | 3/2011 | Ferree | |
| 2014/0361450 | A1 * | 12/2014 | Curtis | F28D 5/02 261/110 |
| 2015/0330710 | A1 * | 11/2015 | Curtis | F28C 1/02 261/29 |
| 2016/0146540 | A1 * | 5/2016 | Curtis | F28C 1/02 261/30 |

FOREIGN PATENT DOCUMENTS

| | | | |
|---|---|---|---|
| JP | S49-011345 | U | 1/1974 |
| JP | S52-19245 | A | 7/1975 |
| JP | S51-125666 | A | 11/1976 |
| JP | H09-89493 | A | 4/1997 |
| JP | H10-220972 | A | 8/1998 |
| JP | 2000-130800 | A | 5/2000 |
| JP | 2002-370518 | A | 12/2002 |
| JP | 2003-314972 | A | 11/2003 |
| JP | 2004-232925 | A | 8/2004 |
| JP | 2008-292065 | A | 12/2008 |
| JP | 2009002528 | | 1/2009 |
| WO | 99/19055 | A1 | 4/1999 |
| WO | 2004/072569 | A1 | 8/2004 |
| WO | 2009/070691 | | 6/2009 |

* cited by examiner

DIRECT FORCED DRAFT FLUID COOLER/COOLING TOWER AND LIQUID COLLECTOR THEREFOR

This application claims the benefit U.S. Provisional Application Nos. 61/208,995 filed Mar. 3, 2009; 61/217,822, filed Jun. 5, 2009: and 61/270,723 filed Jul. 13, 2009, and is a divisional application of U.S. patent application Ser. No. 13/148,541 filed Sep. 13, 2011, now U.S. Pat. No. 9,033, 318, the disclosures of which are incorporated herein by reference.

BACKGROUND OF THE INVENTION

The present invention relates generally to direct forced draft fluid coolers/closed loop cooling towers and/or compact cooling towers and more particularly to an improved air diffusing water drainage collection system for such coolers and towers.

DESCRIPTION OF THE PRIOR ART

Conventional types of industrial cooling towers include so-called counterflow lowers wherein water or other liquid fails or is sprayed downward in the tower counter flow to air moving upwardly in the tower, in the opposite direction. Such systems are used for a variety of applications including water air scrubbers, dust collection equipment, air cooling towers, evaporative coolers, fluid coolers or closed loop cooling towers, evaporative condensers or the like. Typically such industrial cooling towers are quite large and permanent installations which include very large bottom sumps to collect the falling water.

Some relatively small towers for such purposes have been built which are transportable, for various applications, such as small rooftop towers. For example, U.S. Pat. Nos. 5,227, 095 and 5,487,531 issued to Harold D. Curtis, disclose Individual modular towers of a size that can be readily transported, prefabricated at a factory, and then easily assembled at a field site to provide the capacity required by the particular water/liquid cooling or treatment project at the site. The systems disclosed in the Curtis patents have a fan or fans for supplying air to the tower located in the bottom of the tower below the fill, evaporative cooling media, or liquid cooling coils. The fans force air directly upward in the tower. These systems are referred to generally as direst forced draft counterflow cooling towers.

Another modular type of direct forced draft counterflow cooling lower with bottom fans is disclosed in U.S. Pat. No. 5,545,356.

Each of these systems uses a large water or liquid collection basin, sump or reservoir to collect and contain the circulating water for the system. These basins or sumps are typically very large because they have to contain enough liquid to charge the system, including ail associated piping. Because the process liquid (often, but not always, water) in these systems will scrub the air and collect airborne particles, such particles will settle out in the basins, sumps or reservoirs which then have to be periodically cleaned and the large volume of liquid in the system dumped, cleaned or disposed of. In essence, such basins, sumps and reservoirs become internal sediment basins. Such basins are maintenance intense and require workers to enter and work in a confined space to perform cleaning. At the same time the large volume of liquid itself may require treatment rather than disposal further adding to costs. Moreover, the volume of liquid in such systems greatly increases the weight of the system and thus increases rooftop loading.

In addition to the issues of sedimentation, liquid volume and disposal previously proposed tower systems have not adequately addressed the problem of air diffusion by their respective liquid collection systems. Generally, cooling tower (or other forms of towers like fluid coolers) efficiency is determined by how well the up-flowing air is mixed with the downcoming liquid. The fans in such systems are, of course, round and the air is not evenly distributed across the tower media or elements since the fans do not deliver a balanced air flow. Thus, for example, in the systems disclosed in U.S. Pat. Nos. 5,227,095 and 5,487,531 a plurality of parallel elongated collection plates are used in the liquid collector which are sloped and overlap. These plates limit, if not block off, air flow on the wall areas of the tower and cause the air to enter the till media, or heat exchange fluid cooler coils above it, at an angle which forces much of the air to one side of the tower or housing. These factors significantly affect the quality of the air entering the tower and thus reduces thermal performance of the tower.

OBJECTS OF THE INVENTION

It is an object of the invention to provide an improved transportable cooling tower and/or fluid cooler system.

Another object of the invention is to provide an improved air diffuser and liquid collection system for use in forced draft cooling towers and fluid coolers.

A further object of the invention is to provide low profile, transportable cooling towers and/or fluid coolers with a liquid collection system that reduces liquid loads in the system and facilitates cleaning and/or liquid replacement.

SUMMARY OF THE INVENTION

In accordance with an aspect of the present invention low profile, transportable cooling towers and/or fluid coolers/closed loop cooling towers are disclosed winch include a novel water/liquid collector/air diffuser system located above one or more fans in the base of the tower housing. The liquid collector of the invention is positioned below the fill media in the tower or the heat transfer coils of the fluid cooler. It collects substantially ail of the liquid flowing through the fill or heat transfer cods and directs the same to an internal gutter, or gutters, which supply the collected liquid to external collection tank from which the liquid is returned to the top of the tower. The liquid collector also serves to diffuse air from the fans across the width of the tower so that air flow through the fill media or heat transfer coils is uniform.

In accordance with another aspect of the present invention, the low profile transportable cooling lowers and/or fluid coolers have an external water/liquid collection tank which holds a relatively low volume of liquid laterally of the fans and which is easily accessible for cleaning.

In accordance with a further aspect of the present invention a water/liquid collector and air diffuser for use in a low profile transportable cooling tower and/or fluid cooler is provided which is formed from a plurality of elongated V or U shaped laterally spaced troughs which form or define channels arrayed in a plurality of layers. The troughs in each layer are offset from the troughs in the layers above or below it to capture substantially all downflowing liquid in the tower to provide substantially a 100% complete wet/dry barrier between the till media or heat exchanger and the fans while producing a uniform diffusion of air flowing upwardly.

The water/liquid collection system of the invention can be utilized in equipment such as water air scrubbers, dust collection equipment, cooling towers, evaporative coolers, fluid coolers, evaporative condensers and any equipment that utilizes water or any liquid fluid for scrubbing, cleaning, or evaporative cooling. In addition to collecting all of the downcoming liquid the liquid collection system provides a low-pressure means for the air to flow vertically up between the liquid collection troughs and into the cooling media or fluid cooler coil system. The channel forming troughs are strategically positioned to direct and defuse the upflowing air to enhance even airflow through the till media or heat exchanger. This creates a much more efficient air to liquid mixture, significantly improving thermal performance of the cooling tower. In addition, previously proposed liquid collectors have a significant pressure drop across the collector panels. The present Invention will reduce the pressure drop as compared to the existing technology. This will further increase thermal performance of the cooling tower. Moreover, the liquid collector system of the present invention can be produced much more economically than the present technology.

As a result of the structures of the present invention the use of sumps, basins or reservoirs below and around the bottom fans of the towers is eliminated, thereby further reducing the height and weight of the towers. This also reduces the cost of manufacturing the units. In addition, the utilization of an external liquid collection tank laterally of the fan or fans reduces the amount of process liquid needed in the system as compared to conventional arrangements in which collections basin are below the fans. With the present invention only sufficient liquid to prevent the pump from cavitating is needed.

Utilizing the liquid collection/air diffuser system of the present invention with forced draft air systems containing fans mounted in the bottom of the towers provides several advantages.

First, the fans operate outside of the wetted air system. This feature greatly reduces fan maintenance cost and extends the fans' serviceable life. Also, the fans are accessible and can be serviced and/or removed from below the unit without the need for service personnel to enter the environmentally unfriendly wetted areas of the equipment. This feature will also greatly reduce maintenance cost, and not expose service personnel to any unnecessary health risks.

Second, by facilitating the use of bottom-mounted fans the need for air intake louvers and air plenum chambers is eliminated because the liquid collection system diffuses the upflowing air. In addition, the height of the equipment will be reduced because the plenum chamber and air intake louver have been eliminated. The air then is drawn from below the equipment in the space between the rooftop or ground level and the fans. This reduction in the height and weight of the equipment will further reduce manufacturing, shipping and hoisting cost.

Third, bottom-mounted fans are much more efficient than either top or side mounted fans. When moving airflow into a square box with a round fan it is challenging to make sure the cooling media has adequate and uniform airflow coverage. The air supplied to towers having top or slue mounted fans must turn from horizontal to vertical immediately prior to entering the cooling media and does nor enter the bottom of the media uniformly. As a result voids are created. With bottom-mounted fans air is ingested in the open space between the ground or rooftop levels and the fan. The air makes its 90 degree turn as it enters the fans. That air flows laterally inward under the tower and tends to move toward the center of the fill material. In conventional systems that lends to create a void around the perimeter of the cooling tower. This is due in part to the difficulty that the air encounters in making the ninety degree turn from lateral motion to upward motion. Further, the fans of induced draft cooling towers are near the center of the towers and thus all of the air flow tends to funnel toward the center of the fill media. With the present invention, the fans provide a very vigorous blast of air against the under side of the liquid collector and the fill or heat exchange coils above it, in effect creating a pressurized plenum so that relatively uniform dispersal of the upwardly flowing air is provided. Thus the bottom-mounted fans produce a more efficient air to liquid mixture significantly improving thermal performance.

In addition, warm air normally rises vertically. This natural energy can be optimized to increase airflow efficiency.

The liquid collection system of the present invention is dimensioned to contain all of the downcoming liquid from the tower and directs the liquid into gutters positioned on one or two sidewalls of the tower or housing. The gutters are closed on one end and cause the liquid to flow in one direction into the external lank positioned at one end of the unit. The external collection tank of the invention is also advantageous as it allows complete elimination of the eaten basin or reservoir located beneath the equipment as used in all water cooled equipment. Because these basins collect the downcoming water or liquid, airborne contaminants in the liquid collect and settle into the basins. These basins then must be periodically cleaned and are a significant maintenance cost. The basins must also maintain a certain vertical depth of liquid as to assure adequate pump head so that cavitation of the pumps will not occur.

The external tank has a four-sided sloped or conical shape at its bottom that creates a small-defined space at its very bottom. Silt, dirt and other water or liquid borne debris will settle into that small portion of the sloped bottom of the tank. This produces several vest saving benefits.

First, because of the elimination of the basin, the cost of cleaning the basin is completely eliminated. Thus debris can be purged from the bottom of the collection tank with a valve on a periodic basis either manually or automatically. The debris can be disposed of through a standard drainpipe or by other means. In the event that additional cleaning of the collection tank is required it is easily accessible by opening the tank lid. The automatic purging of the tank to dispose of sediments eliminates the need to enter the confined spaces of the equipment to clean and eliminate any unnecessary health risk or environmental exposure associated with disposal of sediments.

Second, the external collection tank only requires a minimum amount of liquid to charge the system. This feature greatly reduces the weight in the equipment as compared with conventional basins. As noted above this liquid must be periodically disposed of and with the tank of the invention only a few gallons of liquid are necessary to purge the system as compared to hundreds of gallons with conventional basins.

A third advantage provided through the use of the liquid collection system of this invention as contrasted to a ground level catch basin is that a much lower pump head for the pump is required to return the liquid to the liquid distribution system. The pump need effectively only provide a pump head equal to the differential between the elevation of the upper level of liquid within the tank and the elevation of the distribution pipe. Conventional systems on the other hand must provide a pump head from the ground level at which their catch basin is located all the way up to the uppermost extent of the lower where the liquid distribution system is located, typically a height on the order of twenty feet or more. The pump head which must be provided by the pump in the present invention is only a few feet, thus greatly reducing required pumping capacity, this is a very substantial economic savings for the operator of the tower as compared to conventional induced draft towers.

As will be appreciated from the above discussion, the direct forced draft counterflow systems of the present invention provide many advantages as compared to induced draft counterflow water cooling towers which are now most commonly used its the industry.

First, there is a major advantage in reduced initial construction costs of the modular units which can be prefabricated as compared to typical site built induced draft counterflow cooling towers. The traditional induced draft counterflow water cooling towers are typically from twenty to thirty feet high and they involve a very large and expensive structural skeleton for supporting the heavy fans located thereabove and various other structures commonly associated with large physical systems of that type due to prevailing safety regulations. All of this is eliminated by use of the modules which have the simple lightweight fiberglass or metal frames set on piers or the like.

Second, in addition to the reduced cost, there is also a substantial improvement in the delivery times available for compactly constructional towers as compared to site built towers. Typical site built induced draft towers take approximately one year to construct after the letting of the contract. The towers of the present invention can be assembled horn prefabricated modules stocked in a warehouse, and the delay from letting of contract to the assembly and start-up of a cooling tower can be reduced to a matter of a month or two or even a few weeks if necessary.

Third, the ability to use small direct drive fans also eliminates the mechanical problems typically involved with large towers which traditionally use very large fans having gear boxes between the motors and fan drives. Mechanical maintenance for the customer is greatly reduced in that they can simply stock a few replacement fans and upon encountering mechanical difficulties, the problematic fan unit can be removed and replaced, with the damaged fan unit than being taken to a shop for repair. This can be accomplished with minimal if any down time of the tower itself.

Further, accessibility to the fan units is very easy since the space below the fans is open allowing them to be accessed from below.

Another efficiency is that the fan units of the present invention cause a very turbulent impacting on the an which flows upward in the water collector and through the fill material or heat transfer cods thus causing a better distribution of the air and better cooling as the air turbulently impacts water flowing down through the tower. This is contrasted in induced draft cooling towers where the air flow is in a rather laminar fashion.

Another advantage is that fan efficiency in general is greatly improved when using a fan in a forced draft mode rather than in a induced draft mode. Further, having the fan very close to the fill material or heat transfer coils reduces functional flow pressure losses of the air again improving fan efficiency.

Another advantage of the towers is the ease with which they can be placed in difficult locations. For example, the towers will be ideal for use as rooftop cooling towers placed on the top of large office buildings and the like. The tower can be simply lifted into place with a crane and set onto a simple support structure. That is contrasted to the great difficulty of site construction of induced draft cooling towers on such building top locations, particularly in a heavily populated downtown office environment.

In summary, the water collection system, when utilized in water operated equipment, offers many cost saving features as well as eliminating health and safety risk associated with water equipment including:

Increased thermal performance
Reduced energy consumption
Reduced water volume and water weight in the equipment
Reduced water and chemical requirements
Reduced maintenance and increased equipment longevity
Reduced equipment weight
Elimination of air intake louvers
Elimination of plenum chamber
Reduced structural height of equipment
Elimination of basin
Reduced manufacturing cost
Removal of fan equipment from wetted exhaust air stream
Self-cleaning water sump
Elimination of pump cavitations
Environmentally friendly
Elimination of need to enter the wetted area to service a basin or fans The above and other objects, features and advantages of the present invention will be apparent to those skilled in the art from the following detailed description of illustrative embodiments thereof when read in conjunction with she accompanying drawings wherein.

BRIEF DESCRIPTION OF THE DRAWINGS

FIG. 15 is an end view similar to FIG. 14 showing the portions of the dampers when the fans are on;

DETAILED DESCRIPTION OF THE PREFERRED EMBODIMENTS

Figure 1:
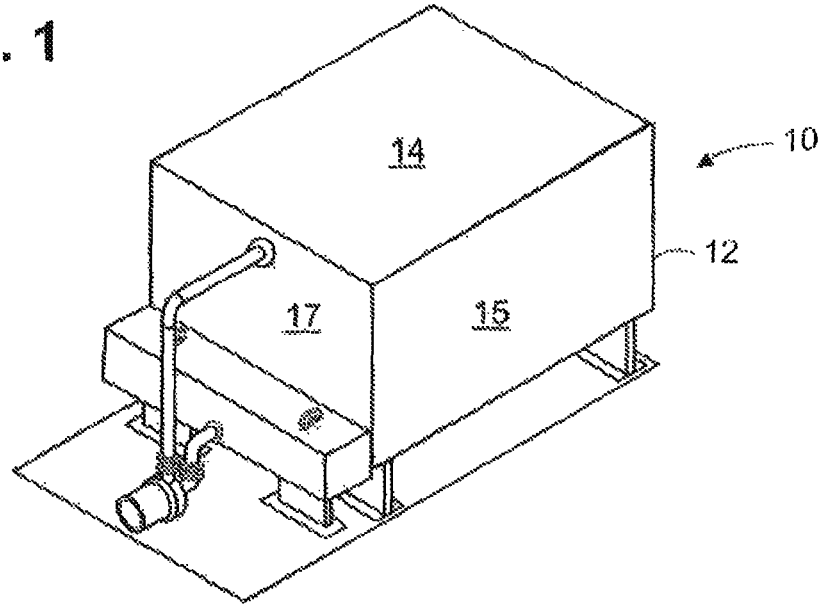
FIG. 1 is a perspective view of a direct forced draft/fluid cooler constructed in accordance with the present invention.

Referring now to the drawings in detail and initially to FIG. 1, a direct draft fund cooler 10 is illustrated. The cooler is designed to advantageously use the evaporation of water or other liquids to cool a second liquid in a heat exchanger located within the device. The systems of the invention can be used with water or other suitable liquids and although the illustrative embodiments are described as utilizing water the invention is not so limited.

Figure 2:
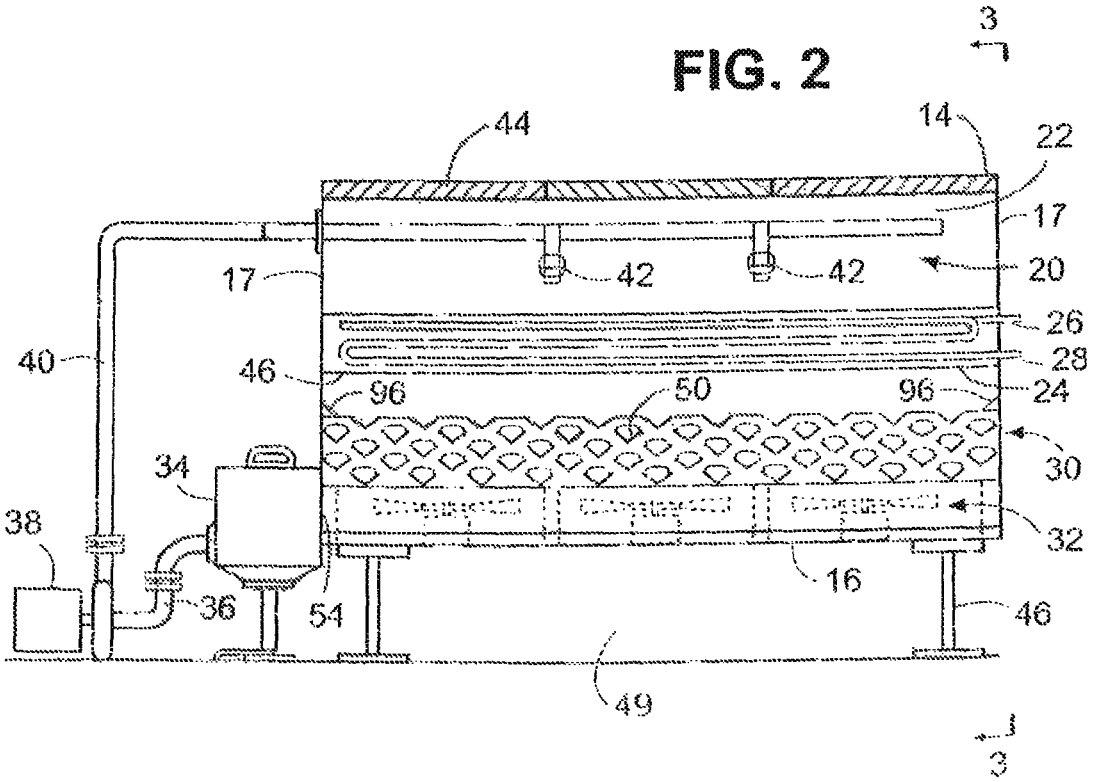
FIG. 2 is a side elevational view, with the sidewall removed, of the invention as shown in FIG. 1.

Fluid cooler 10 includes an exterior housing 12 having an open top 14, vertical side walls 15, end walls 17 and a bottom wall 16. As seen in FIG. 2, wherein the side wall 15 has been removed to illustrate the interior of the cooler, housing 12 contains a liquid distribution system 20 at its upper end 22, and a heat exchanger 24 illustrated in the drawing as a cooling coil type structure. The latter is formed as curved piping having an inlet end 26 for supplying liquid to be cooled to the heat exchanger and an outlet end 28 for supplying the cooled liquid to an outside system, e.g., a refrigeration system.

A water collector 30 also is located within housing 12 below the heat exchanger coil 24 for collecting water drat passes through the spaces between the cod system from the water distribution system 20. One or more fans 32 are provided in the bottom of housing 12, supported therein in tiny convenient manner, for drawing air through the bottom opening of the housing and blowing it through the water collector 30 and cooling coil 24 countercurrent to the water distributed from distribution system 20.

Water distribution system 20 includes a collection tank 34 mounted outside the housing 10 at the approximate level of the fans to receive water collected by collection system 30, as described hereinafter. The collected water is discharged from the tank 34 through a discharge pipe 36 to a pump 38. The pump recirculates the liquid through the distribution pipe 40 to winch a plurality of nozzles 42 are connected inside the housing. These nozzles create a downward spray of water in the housing above the heat exchange coil 24. These nozzles may be of any known construction, suitable for use in fluid coolers or evaporative cooler devices, but preferably are spray nozzles of the type disclosed in PCT International Publication No. WO2009/070691.

A known form of drift eliminator structure 44 is mounted in the opened top 14 of housing 12 to intercept, trap and collect mist blown through the heal exchange coil 24 to prevent the mist from escaping to the atmosphere. Such drift eliminators are well known in the art and need not be described here in detail. Examples of suitable drift eliminators are shown and described in U.S. Pat. Nos. 5,227,095 and 5,487,531, along with then mountings. The disclosures of those two patents are incorporated herein by reference.

Figure 3:
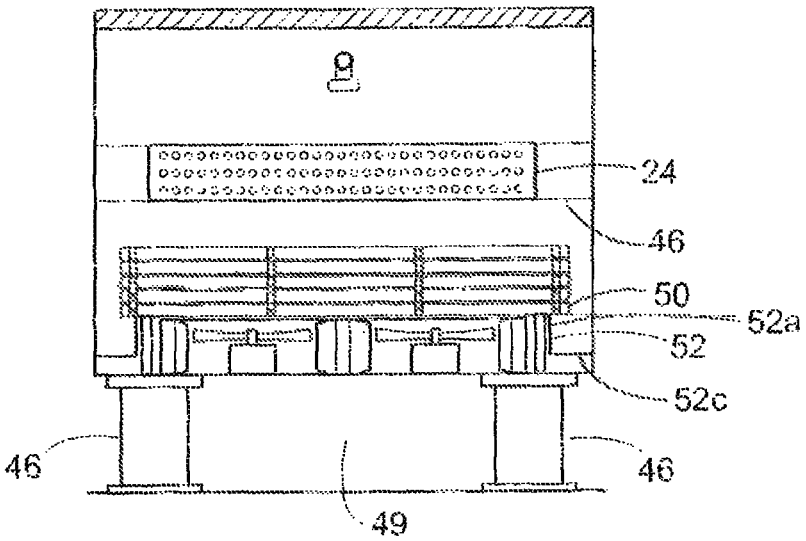
FIG. 3 is a sectional view taken along line 3-3 of FIG. 2.

As illustrated in FIGS. 2 and 3, housing 12 and the equipment mounted therein are supported by a pair of I-beams 46, or any other convenient form of foundational support, on the floor or on the ground, or, for example, the roof of a building. Thus that the bottom of housing 12 is spaced from the floor support to allow air to flow into the space 49 formed by this structure, where it is drawn into the housing by fans 32.

FIG. 3 of the drawings is a view taken along the line 3-3 of FIG. 2 with the rear wall 17 of the housing removed to expose the interior. As seen therein, the heat exchanger coil 24 consists of a plurality of turns of the piping forming the coil so that fluid to be cooled entering at the coil inlet entrance 26 has a relatively long path of travel within the cooler for exposure to the cooling effects of the counter-flowing air and liquid from the distribution system 20 passing therethrough. The coil structure can be manufactured in any convenient manner and supported by brackets or a perforated housing 46 within the housing 12, in any convenient manner known to those skilled in the art.

As seen in FIGS. 2 and 3, the water collector system 30 includes a plurality of V-shaped troughs 50 arrayed in multiple layers as described in greater detail hereafter. These troughs collect the liquid passing through the coil 24 to intercept the liquid and direct it away from fans 32. As illustrated in FIG. 3, the ends of the troughs 50 are open and the system 30 is supported on an L-shaped wall structure 52 at each side of housing 12. This wall structure extends along the length of the housing and, with the side wall of the housing forms a gutter. The two gutters carry the water to openings 54 adjacent tank 34, which openings are connected through waterproof seals or the like to corresponding openings in the tank so that the collected water flows into the tank and can be recirculated as described above.

Figure 5:
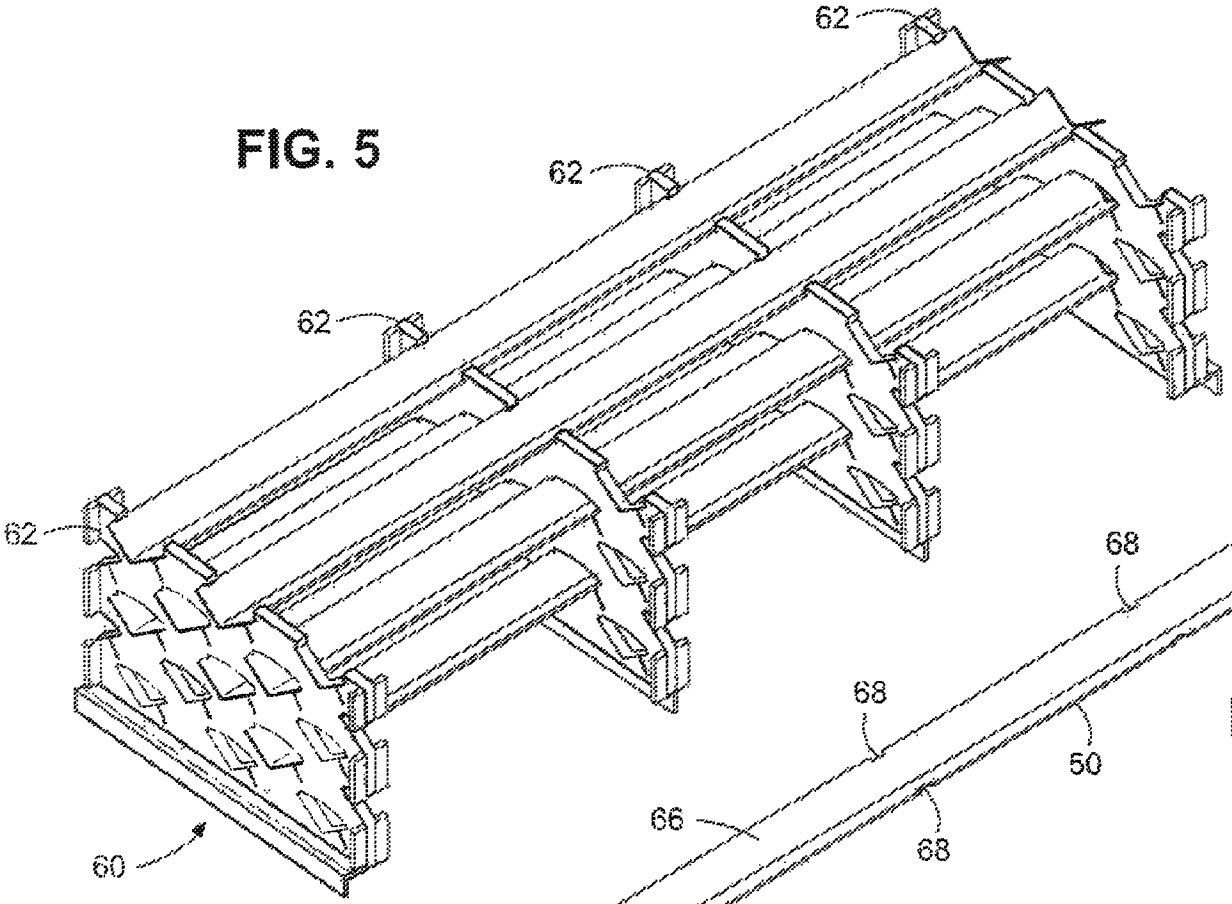
FIG. 5 is a perspective view of one section of a water collector made in accordance with the present invention.
Figure 6:
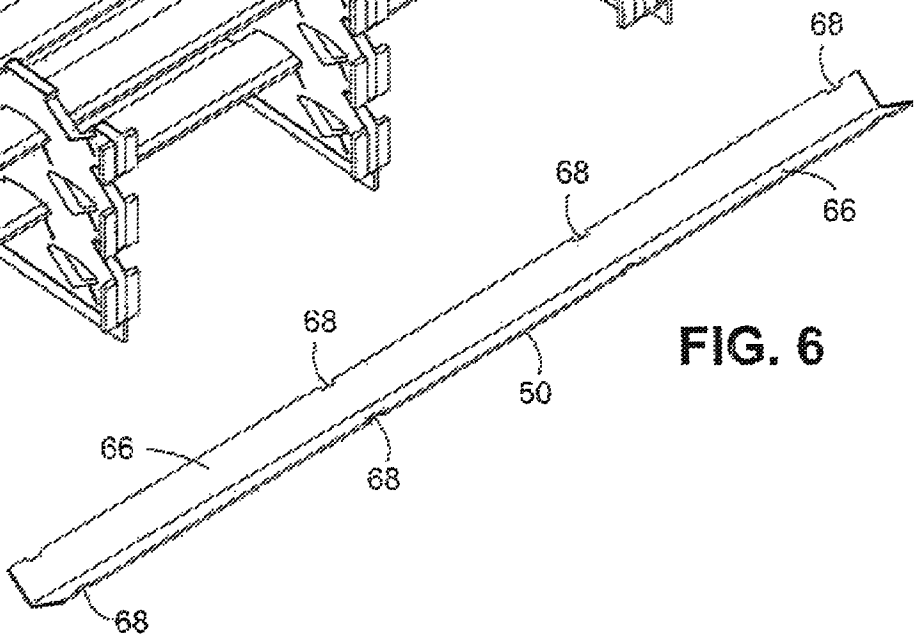
FIG. 6 is an enlarged perspective view of one of the water troughs used in the collector of FIG. 5.
Figure 7:
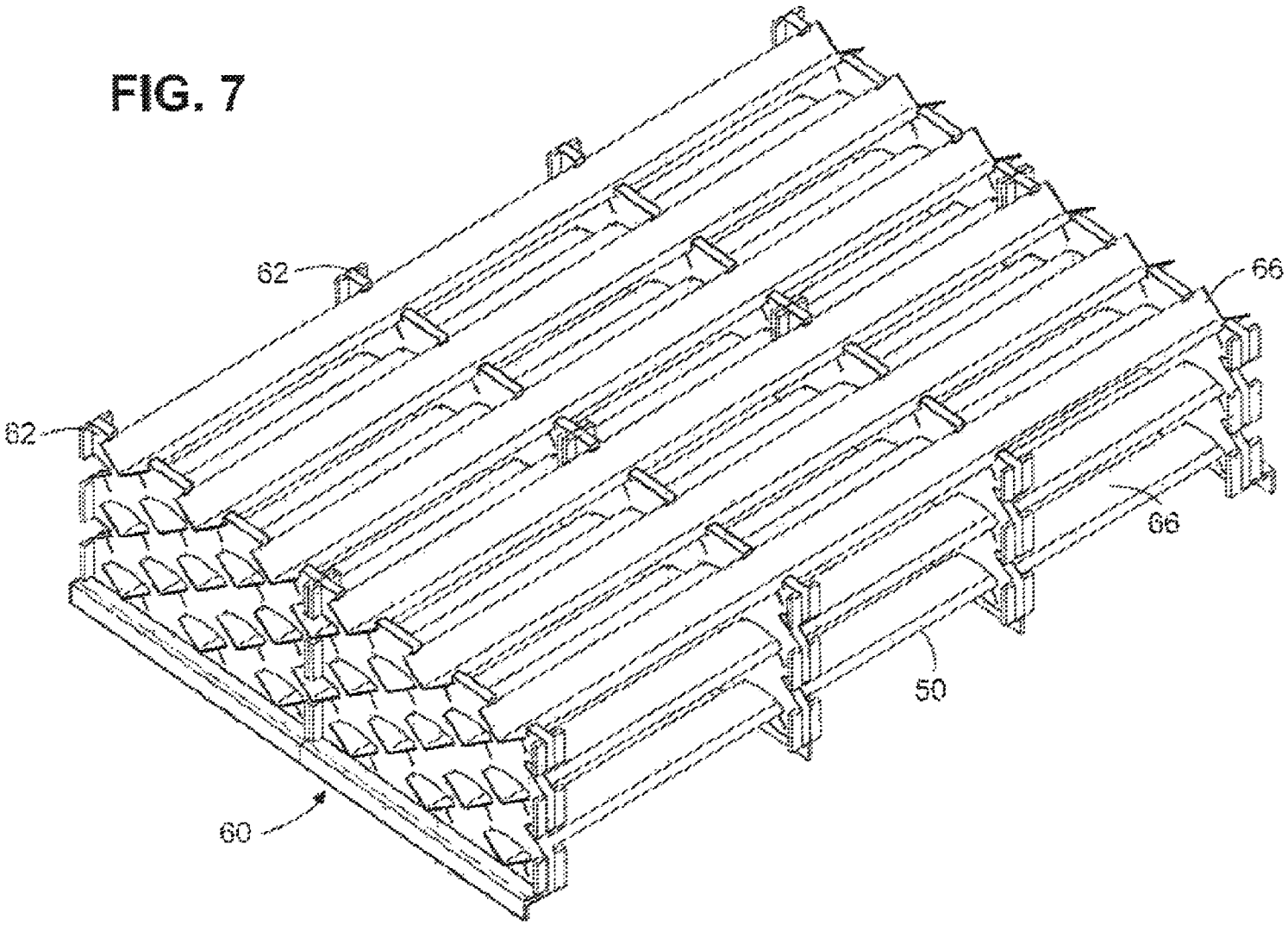
FIG. 7 is a perspective view, similar to FIG. 5, of a pair of water collector sections connected together using the troughs of FIG. 6.

Referring now to FIG. 5 of the drawings, an enlarged perspective view of a portion of the water collector system 30 is illustrated. FIG. 6 is an isolated view of one of the troughs 50. The entire water/liquid collector 30 is formed of a plurality of water collector units or segments 60, as seen in FIG. 5, connected together, as seen in FIG. 7, and described hereinafter. Each of the units 60 consists of a plurality of trough support plates or structures 62 having openings 64 therein for receiving troughs 50. These support plates may be formed of lightweight molded plastic or the like. In the illustrative embodiment, four support plates are provided, but the number of support plates will be dependent on the size of a unit. In the embodiment of the Invention illustrated in FIGS. 5 and 6 troughs 50 are generally V-shaped and formed of a flexible metal or plastic material which allows the legs 66 of the trough to flex for convenience in engaging the troughs in the support plates.

Figure 8:
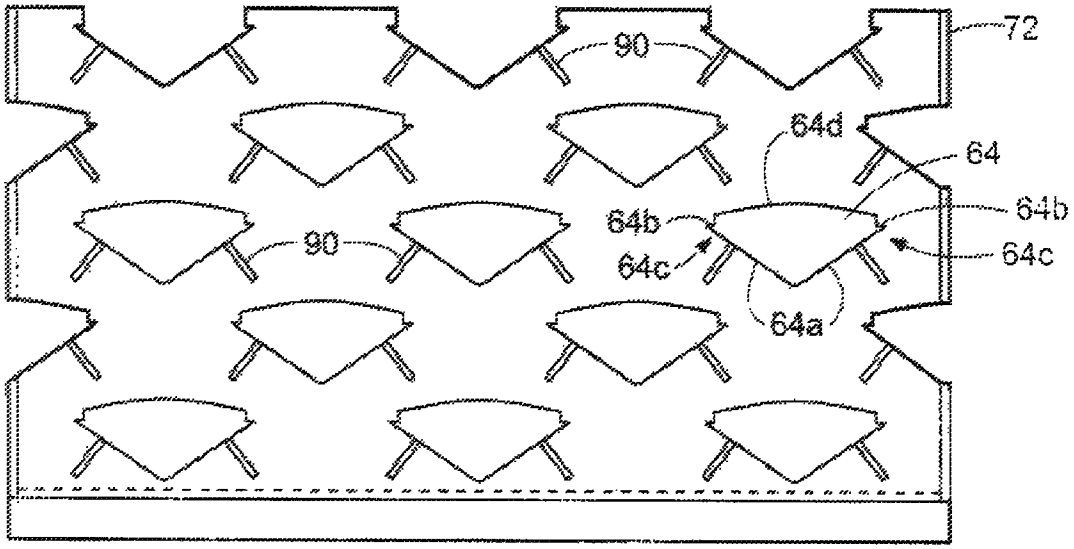
FIG. 8 is an enlarged plan view of a connector plate used in the connector section shown in FIG. 5.

A more detailed view of a support plate is shown in FIG. 8, wherein it is seen that the openings 64 in the plate have a generally V-shaped bottom peripheral configuration that is complementary to the V-shaped configuration of the troughs 50. The V-shaped edges **64*a* of opening 64 terminate at abutments 64*b* which form notches 64*c* in the plate at the ends of the edges 64*a*. The top edge 64*d* of the opening 64 is slightly arched. This structure allows the flexible V-shaped trough to be slightly bent so that its legs 66 approach one another slightly and thus can be inserted longitudinally in openings 64. When the trough is properly positioned in the opening plate openings the notches 68, formed in its legs 66 will snap into place beneath the notches 64*c*** in the plates. This arrangement provides a cooperating means in the water system collector assembly to hold the troughs In the support plates and to stabilize the plates themselves.

The slot and notch design of this system allows tor assembly without utilizing mechanical fasteners while maintaining the structural integrity of the modules. It also provides for ease of removal.

Figure 9:
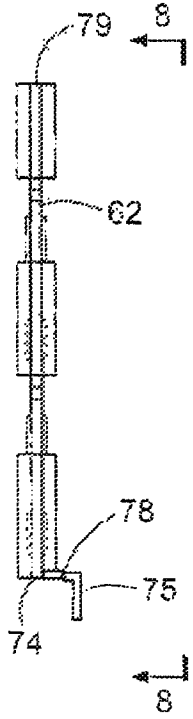
FIG. 9 is an end view of the connector plate taken along line 9-9 of FIG. 8.

Referring to FIGS. 8 and 9, the ends 70 of the plates 62 have transverse wall elements 72 formed thereon. These wall elements will abut one another when a plurality of the water collector segments 60 are positioned in the housing, as shown in FIG. 7. In addition, as seen in FIGS. 5, 7 and 8, the edges 70 of the support plates have partial openings 64 formed in than that are complementary to a corresponding partial opening on an adjacent plate so that when the plate ends they abut they form a complete opening between them. By this arrangement, when a V-shaped trough element 50 is snapped into that opening, the trough itself forms a connection between the two support plates and serves to connect the collector segments 60 together.

As seen in FIG. 9, the bottom edge 74 of the support plate 62 has a thin, offset wall extending therefrom providing a support surface 78 on bottom edge 74 which can rest on the top edge of gutter wall 52*a* for support thereon. In addition, if more than one layer of collection units is used, the units can stack on one another with the support surface 78 resting on the upper edge 79 of plate 62.

Although the preferred embodiment of the invention utilizes V-shaped troughs 50 as described above to provide liquid collection channels to lead the collected liquid to the gutters, it should be understood that other convenient shapes such as U-shaped troughs can be used as well. In addition although, as illustrated in FIG. 3 the opposed ends of the troughs are open to supply the water to a pair of gutters, if desired, one end of the troughs can be closed so that ail of the liquid is supplied to a single gutter in the housing.

Figure 11:
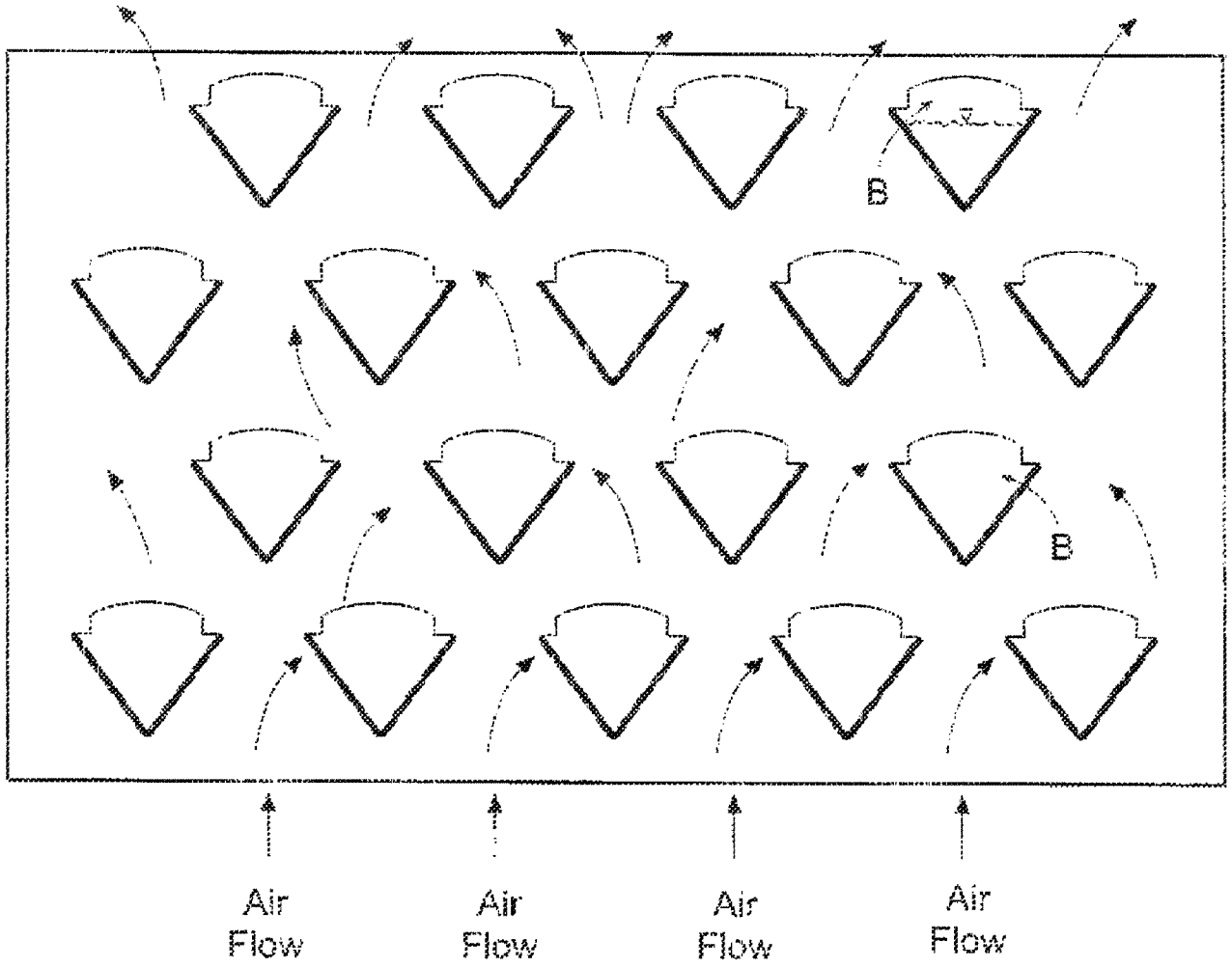
FIG. 11 is a schematic end view of one section of the water collection system showing the relationship of the water troughs to each other and the air flow paths therethrough.

Referring now to FIG. 11, a schematic illustration of the array of the troughs in the water collector is provided. As seen therein the air flowing from the fans encounters the lower laser of troughs 50, passes through the gaps between the troughs, and is diffused against the bottom of the troughs above them. This diffusion pattern continues through the multiple layers of troughs so that at the top of the water collector system the air is fully diffused for uniform How through the cooling coil and thus uniform heat transfer. As also seen in FIG. 11, troughs 50 in each layer are laterally spaced from one another and offset relative to the troughs in the layer above or below it. The space 78 between the ends of the troughs in each layer is less than the width of the troughs themselves, thus increasing the opportunity for the troughs to collect liquid flowing down towards the fans as mist or droplets through the collector.

In one preferred embodiment the width between the legs of a single trough 50 is about 3 inches while the spacing between the ends of adjacent legs is 2 inches.

It has been found that using five layers of troughs as shown in FIGS. 2-9 will collect, substantially 100% of the water droplets which pass through the heat exchanger return to the tank 34. If desired, however, more or less layers can be utilized.

Of course it is to be understood that the uniform spacing of the troughs described above is nor mandatory. Indeed, depending upon the application or the specific shape of the housing, it is within the scope of the invention to vary the spacing between the troughs in order to direct air flow to specific areas. In addition, varying the size of the openings between adjacent troughs will effect the air velocity between the troughs. By varying the gap between them, air distribution can be better balanced throughout the system. However, it is important that the troughs remain overlapped, as described above, so that water cannot escape to the fans.

Figure 10:
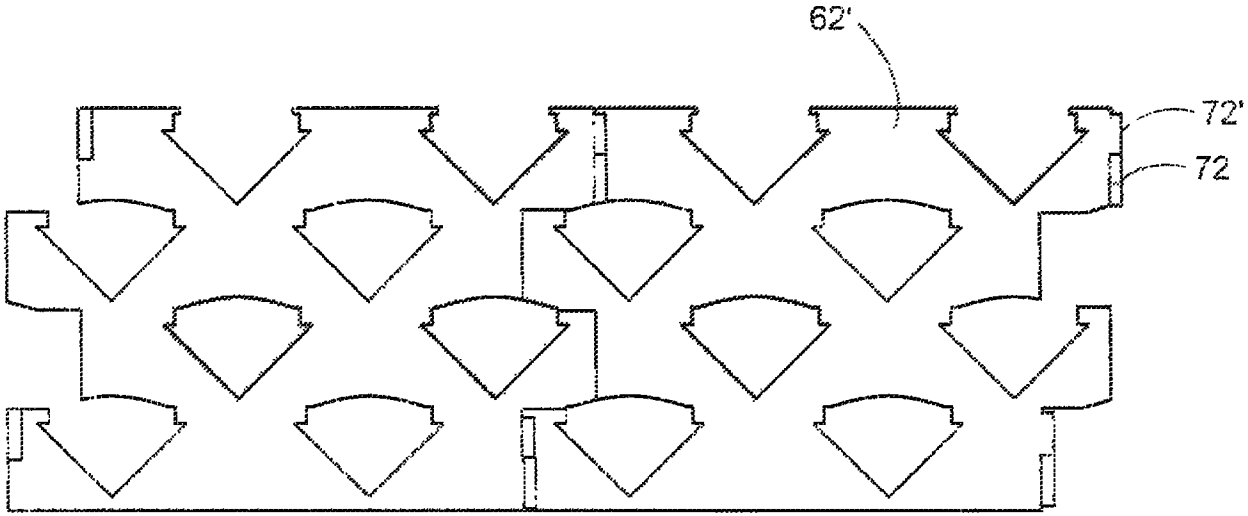
FIG. 10 is a plan view of a second embodiment of connector plates showing two plates mated together.

FIG. 10 illustrates a support plate structure similar to that previously described, but using four layers of collecting troughs. In this case, the support plate 62' has a somewhat different end configuration so that the edges of the place interdigitate and the traverse walls 72 on the end edges overlap to support one another. Alternatively, these transverse walls can have snap fitting structures, such as recessed U shaped tonus that will receive and functionally engage the flat opposed edges 72' of an adjacent plate to snap the adjacent plates together.

Figure 12:
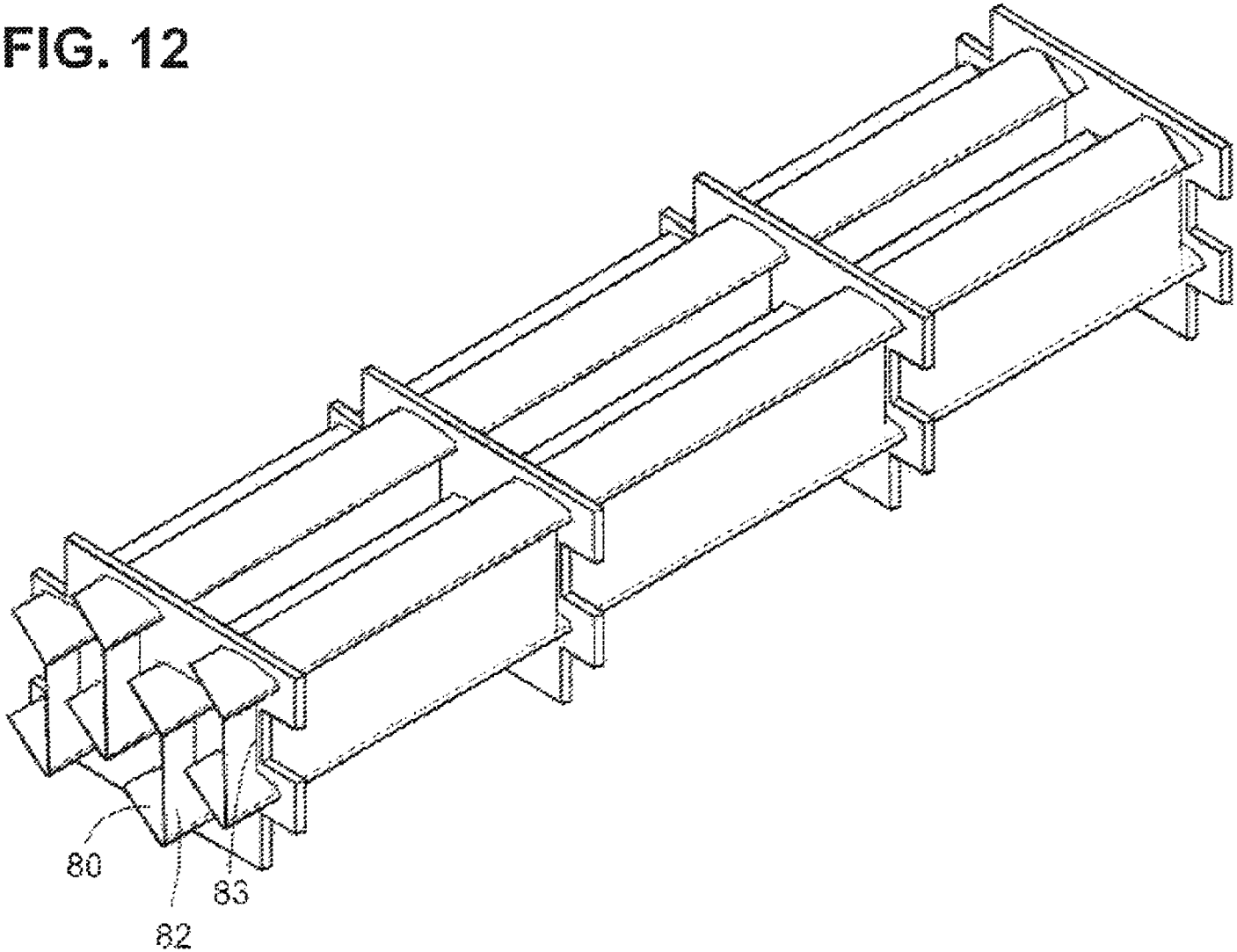
FIG. 12 is a partial perspective view similar to FIG. 5 of a water collection system according to another embodiment of the invention.
Figure 13:
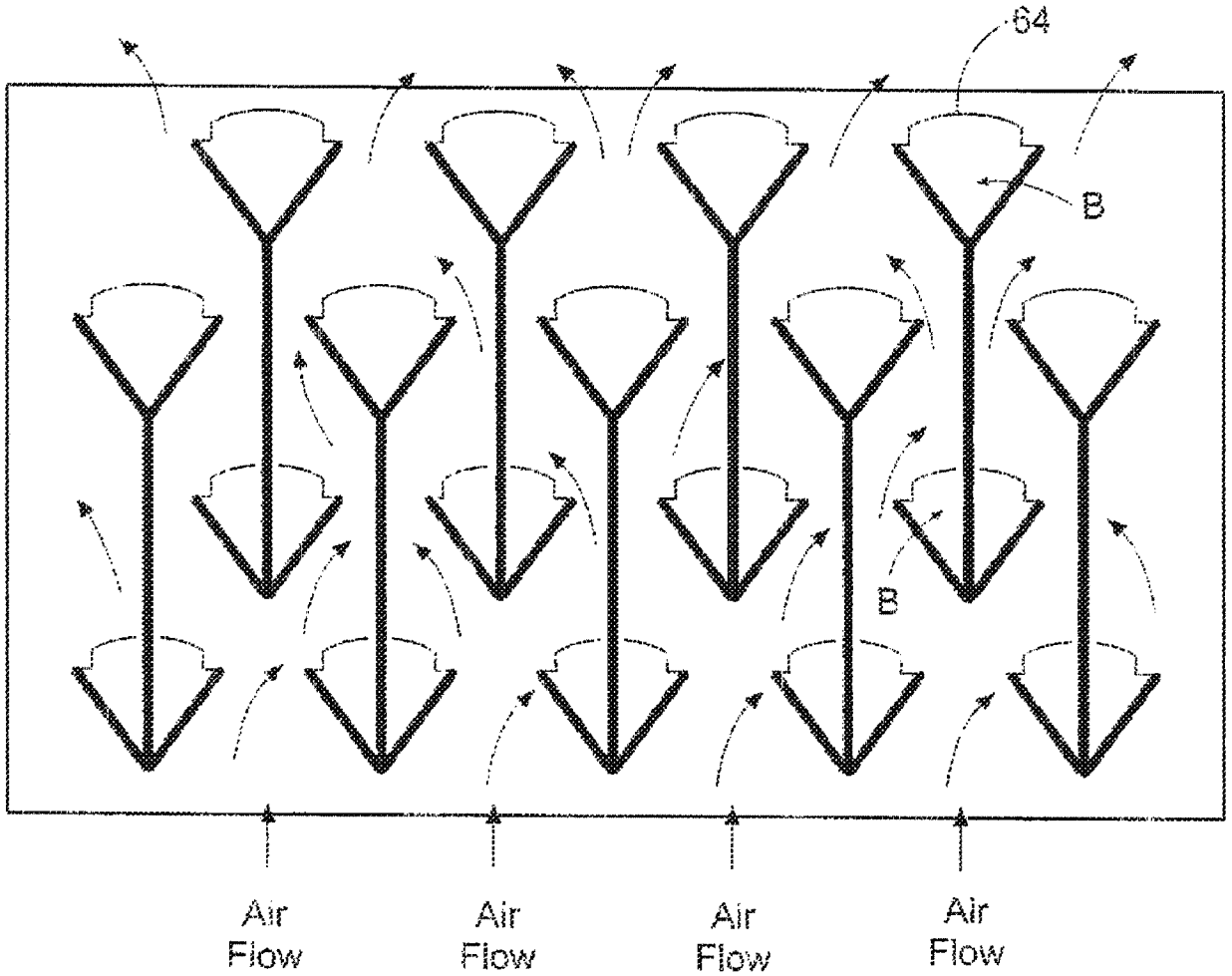
FIG. 13 is a schematic end view similar to FIG. 11 of the relationship of the troughs of the FIG. 12 embodiment to one another and the air flow paths therethrough.

FIGS. 12 and 13 illustrate schematically another embodiment of the present invention. In this case, rather than using individual troughs SO as in the prior embodiment, pairs of troughs 80 are provided, which are connected by an integral web 82 extending vertically between their apexes. These structures would snap into openings in the support plates corresponding to the openings 64 previously described. However the plates in this embodiment would include slots 83 extending between the openings 64 to accommodate the webs 82. In FIG. 12 the plates and their openings are simply illustrated schematically. By providing the troughs in pairs connected by the web 82, somewhat greater rigidity is provided to the structure.

Referring again to FIG. 8, the trough support plates include ribs 90 formed therein extending downwardly and away from the troughs toward the troughs therebelow. It has been found that in the course of operation of a cooler in accordance with the present invention the liquid from system 20 can condense on the surfaces of the plates and move in a film downwardly along the support plates. That condensation needs to be collected so as not to enter the fan area. Accordingly, ribs 90 break up the condensation film as it moves downwardly and directs it to the water collection trough immediately therebelow. Likewise, condensation can form on the interior surfaces of the walls of the tower. Accordingly, on the end walls 17 deflector plates 96 are provided, as seen in FIG. 2, to direct condensate moving down those walls into the troughs. On the sidewalks, as seen in FIG. 3, no such deflector plates are required because the condensate will flow directing downwardly into the gutters.

Figure 4:
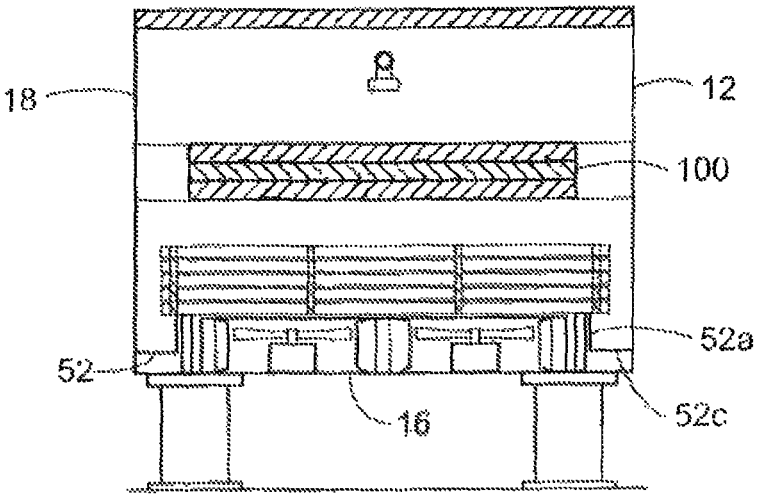
FIG. 4 is a sectional view similar to FIG. 3 of another embodiment of the present invention providing an evaporative cooling tower.

Referring now to FIG. 4, the technology of the present invention is equally adapted to use in evaporative coolers. In no evaporative cooler the liquid is passed countercurrent through an evaporative cooling media of well-known construction forming a layer 100 in the housing 12 instead of through coil 24. The evaporative cooling media can take many forms, and typically could be cross-corrugated sheets of plastic material which form air passageways therebetween through which the liquid and air pass countercurrently. The moisture evaporates in the media as it contacts the air thereby cooling the air for use in air-conditioning systems and the like.

Figure 14:
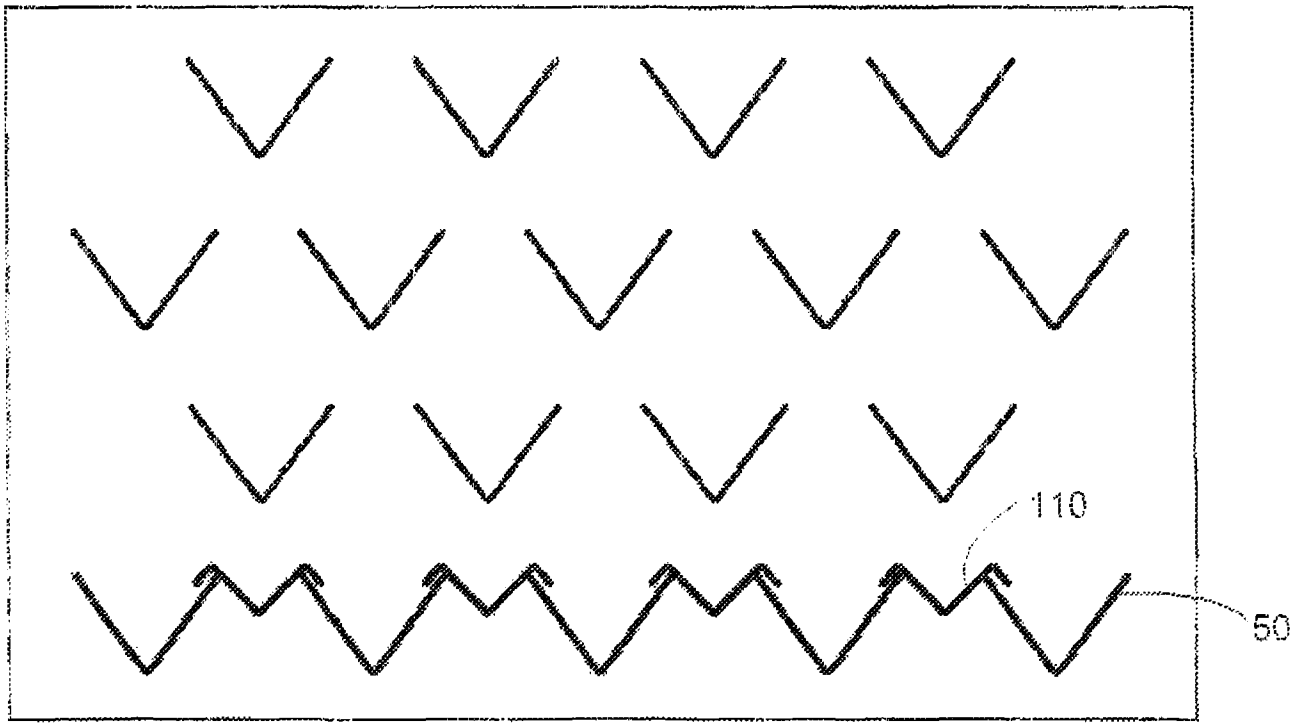
FIG. 14 is an end view similar to FIG. 11 showing the use of dampers to prevent waver flow out of the collector when the fans are off.
Figure 15:
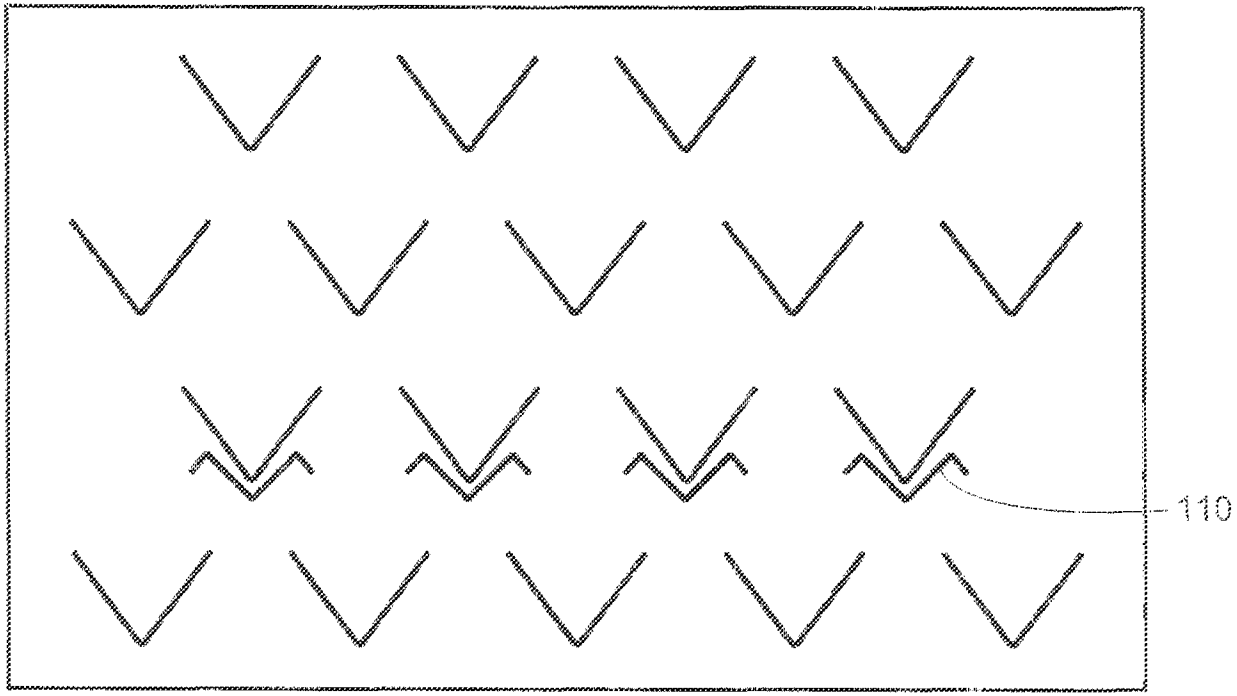

Referring now to FIGS. 14 and 15, a damper system is illustrated for closing the gaps between the troughs 50 in the lower layer of the water collector system to prevent any liquid dripping down through the water collector from the water distribution system from entering the fans therebelow. In the embodiment illustrated in FIGS. 14 and 15, a small trough-like damper 110 is provided in each gap between troughs 50 in the lower layer. The damper 110 has a length corresponding to the length of troughs 50 and has a generally in shape with small outer legs that sit on the upper edges of the legs of each trough. These dampers are lightweight plastic members and will move upwardly, under the influence of air pressure when the fans are on, to the position shown in FIG. 15 and be held against the bottom surfaces of the troughs thereabove. When the fans are turned off, these dampers will settle down onto the top edges of the troughs in the lower level. These dampers may be free-floatings although, if preferred, they could have guide pins formed therein engaging in slots formed in the support plates to guide their vertical movement from the closed position shown in FIG. 14 to the open position shown in FIG. 15.

Figure 16:
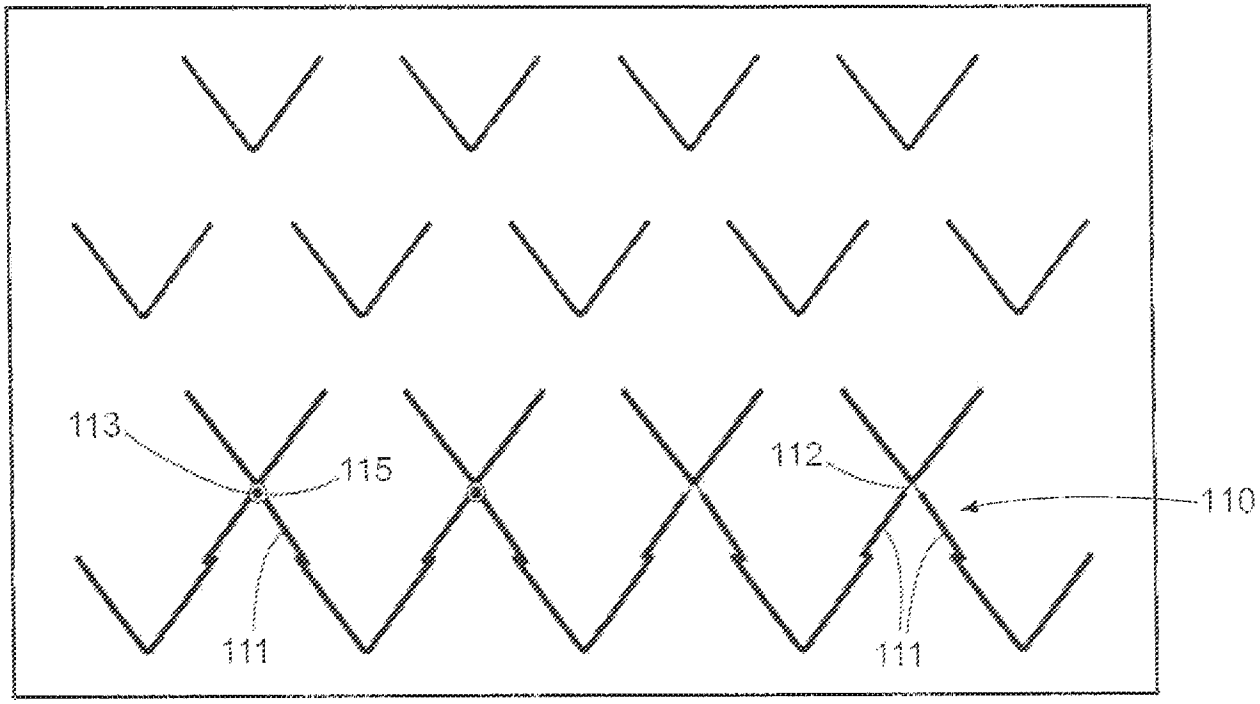
FIG. 16 is an end view of a pair of water collector troughs having a damper pivotally connected thereto.

In an alternative arrangement, as shown in FIG. 16, the dampers 110 may be formed integrally with the troughs using a live hinge 112 or other convenient pivoting mechanism as would occur to those skilled in the art. In this case, when the fans are off the damper would fall by gravity to the position shown in solid lines in FIG. 16, and when the fans are on the damper would be moved to the dotted fine position. As would be understood by those skilled in the art, the dampers would be formed on the troughs in segments, between the notches 68 described above, so that they could be bent into the trough while the trough is being installed in the support plates.

The use of dampers in the present invention is advantageous not only because it keeps liquid out of the fans and avoids corrosion, but keeps the water out in freezing conditions as well, which could create a hazard and damage to the fans.

Figure 18:
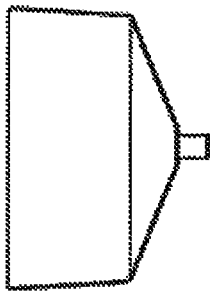
FIG. 18 is an end view of the tank of FIG. 17.
Figure 17:
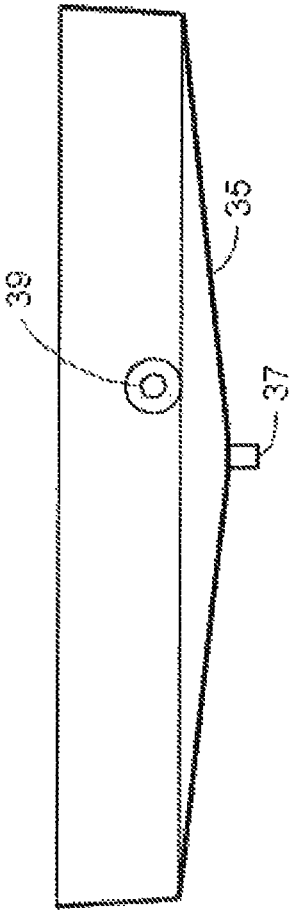
FIG. 17 is an elevational view of the water collection tank used in accordance with the present invention.
Figure 19:
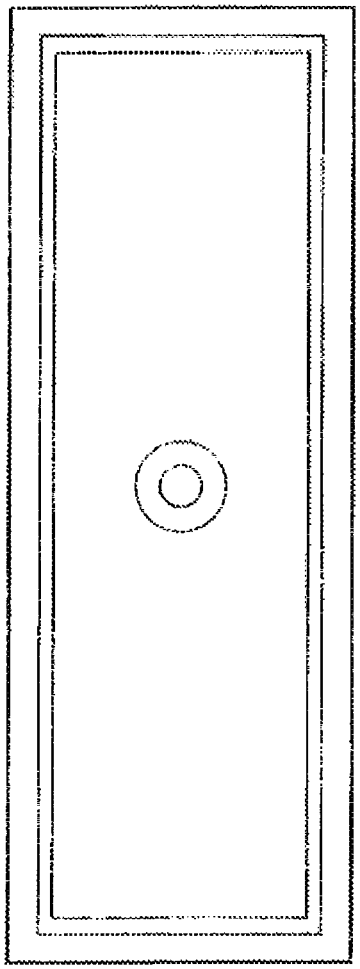
FIG. 19 is a top view of the tank of FIG. 17.

FIGS. 17-19 illustrate the water collection tank 34 in greater detail. In a typical application for use in a direct forced draft fluid cooler or closed loop cooling tower, as described above, this rank is formed to be relatively small compared to prior art devices. It typically would hold approximately 90 gallons of fluid for the entire system. As discussed above, and as seen in FIGS. 17-19, the tank has a tapered bottom 45 either formed by four tapering generally triangular walls or as a conical shape so that all of the liquid is directed to the bottom outlet. By this construction, the sediment and the like that is collected in the operating liquid will settle in the tank into the tapered bottom and can be readily flushed from the system as necessary through drain 120. In addition, because the tank is located exteriorly of the housing, and has a simple removable top 41, there is easy access to the tank for cleaning. Still further, because the tank is located higher than the pump, and due to the location of the outlet 39, the pump will remain primed, and the head required for operation is less than in prior systems, thereby requiring a smaller pump tor operation.

As described above, the system of the present invention provides a number of major improvements. The liquid collection system collects all of the downcoming water, but also directs and diffuses the upflowing air so that all the fill media gets substantially equal air flow across the entire surface of the heat exchanger or fill media. This enhances snore efficient air to water mixtures which increases performance of the system. In addition, the design of the water collectors provides a significant pressure drop across the collector panels, as compared to existing technology. The reduced pressure drop also increases thermal performance of the cooling tower. Moreover, the water collector system is relatively simple and economical to manufacture.

Although the invention has been described herein with reference to the specific embodiments shown in the drawings, it is to be understood that the invention is not limited to such precise embodiments and that various changes and modifications may be effected therein without departing from the scope or spirit of the invention.

What is claimed is:

1. A compact cooling tower comprising:

a housing;

an evaporative cooling pad mounted in said housing;

liquid distribution means located above said evaporative cooling pad for distributing a liquid on said evaporative cooling pad so that said liquid gravitates downwardly through said evaporative cooling pad;

fan means located below said evaporative cooling pad for blowing air upward through the evaporative cooling pad thereby to cool said liquid;

a water collection means in said housing below the evaporative cooling pad including a plurality of layers of liquid collecting troughs for collecting substantially all of the liquid failing from said evaporative cooling pad, said troughs in each of said layers being laterally offset from the troughs in layers of troughs above or below it; said troughs each having at least one open end;

at least a pair of trough support plate structures having openings therein for receiving said troughs, and said plate structures being longitudinally spaced from each other along the length of the troughs; and an external liquid collecting tank means adjacent said housing for receiving said liquid from said water collection means.

2. The apparatus as defined in claim 1 including gutter means in said housing for receiving said liquid from the at least one open end of the troughs and carrying said liquid to said external liquid collecting tank means.

3. The apparatus as defined in claim 1 wherein said tank means is located laterally of said fans.

4. The apparatus as defined in claim 3 including pump means connected to said tank means and to said liquid distribution means for pumping said liquid from the tank means to the equipment to be cooled and then returned to the liquid distribution means.

5. The apparatus as defined in claim 4 including means for connecting said pump means to said tank means for conveying said liquid from the tank means to the pump; said connecting means having a first end connected to the tank means and a second end connected to the pump means at a lower elevation than said first end.

6. The apparatus as defined in claim 4 or claim 5 wherein said tank means has a tapered bottom including a drain hole located at a lower level than the connection of said tank means to the pump means.

7. An apparatus as defined in claim 1 wherein said troughs and plate structures have cooperating means formed thereon for securing the troughs in said openings.

8. An apparatus as defined in claim 7 wherein said troughs extend generally parallel to each other in said layers with a maximum spacing between troughs being less than a maximum width of an individual trough.

9. An apparatus as defined in claim 8 wherein said troughs are V shaped in transverse cross-section.

10. An apparatus as defined in claim 7 wherein said troughs are U shaped in transverse cross-section.

11. An apparatus as defined in claim 1 including means associated with at least one of the lower layers of troughs for closing the space between adjacent troughs in said at least one layer when the at least one fan is off and for opening those spaces when the fans are on in response to air flow caused by the at least one fan.

12. An apparatus as defined in claim 6 wherein said support plate structures include surface rib means adjacent the openings therein positioned for directing any of said liquid on the plate structure to the layer of troughs therebelow.

13. An apparatus as defined in claim 1 wherein said support plate structures each comprise at least two plate elements of substantially identical shape having opposed ends adapted to abut one another and means for securing said abutting ends together.

14. An apparatus as defined in claim 7 wherein said support plate structures each comprise at least two plate elements having opposed ends adapted to abut one another, said opposed ends each having cut out portions formed therein which, together, when said ends are abutting form an opening for a trough and said cooperating means on said trough and plates secure a trough therein and the abutting plates together.

15. An apparatus as defined in claim 14 wherein said plate structures each have at least one pair of said cut out portions formed therein.

* * * * *